US007377222B1

(12) United States Patent
Moore, III

(10) Patent No.: US 7,377,222 B1
(45) Date of Patent: May 27, 2008

(54) CLAMPING DEVICE FOR A SEWING MACHINE AND METHOD

(76) Inventor: E. Frank Moore, III, 6587 Coltrane Mill Rd., Greensboro, NC (US) 27406

( * ) Notice: Subject to any disclaimer, the term of this patent is extended or adjusted under 35 U.S.C. 154(b) by 200 days.

(21) Appl. No.: 11/390,040

(22) Filed: Mar. 27, 2006

(51) Int. Cl.
*D05C 9/04* (2006.01)
*D05B 49/00* (2006.01)

(52) U.S. Cl. ..... 112/470.14; 112/103; 38/102.91

(58) Field of Classification Search ..... 112/103, 112/470.14, 475.18; 38/102.2, 102.91, 102.4, 38/102.3
See application file for complete search history.

(56) References Cited

U.S. PATENT DOCUMENTS 4,831,753 A * 5/1989 Inteso ..... 38/102.3
5,330,143 A * 7/1994 Rich et al. ..... 248/161
5,396,721 A * 3/1995 Levine et al. ..... 38/102.3
5,413,057 A 5/1995 Moore, III ..... 112/103
5,433,158 A 7/1995 Moore, III ..... 112/103
5,586,400 A 12/1996 Moore, III ..... 38/102.2
5,664,350 A 9/1997 Moore, III ..... 38/102.2
5,915,314 A 6/1999 Moore, III ..... 112/103
6,354,234 B2 * 3/2002 Wakasugi ..... 112/470.14
6,374,760 B1 4/2002 Moore, III ..... 112/470.18
6,382,116 B2 * 5/2002 Wakasugi ..... 112/103
6,708,632 B2 * 3/2004 Shibata ..... 112/103

* cited by examiner

*Primary Examiner*—Ismael Izaguirre

(57) ABSTRACT

A clamping device and method for a conventional sewing or embroidery machine has a pair of movable arms. Each of the arms includes a fixed section and a movable section for receiving material or item to be embroidered therebetween. A manual lever allows the movable arm to be raised for insertion of the material and a scale on the arm allows the depth of insertion to be easily determined for accurate insertion. Each arm is movable along a slotted mounting plate affixed to the sewing machine proximate the sewing head. The clamping device provides uniform, taut material for accurate, smooth embroidering.

15 Claims, 6 Drawing Sheets

CLAMPING DEVICE FOR A SEWING MACHINE AND METHOD

FIELD OF THE INVENTION

The invention herein pertains to clamping devices for sewing machines and particularly pertains to a clamping device for use on a typical embroidering machine.

DESCRIPTION OF THE PRIOR ART AND OBJECTIVES OF THE INVENTION

During the process of stitching or embroidering on fabrics and other materials, such materials must be held or contained in a taut, fixed configuration to ensure the embroidery pattern is correctly applied. Wrinkles, gaps or loose material will often create an unacceptable stitching or embroidering pattern and the embroidered item such as a shirt, cap, uniform or the like will have to be reprocessed again or discarded.

Initially hand stitching or embroidered utilized "hoops" formed from wood, metal or plastic that were used to tighten a section of, for example, fabric over a shirt pocket. Once the fabric was "hooped" the embroidery process could proceed with fairly good results. With the advent of high speed sewing machines more accurate "hooping" devices were required and many different types were built for various machine products and materials. The prior hooping devices were awkward in certain respects and were often difficult to load, adjust and unload after the stitching/embroidering process was complete.

Thus in view of the known problems and disadvantages of prior hooping or clamping devices the present invention was conceived and one of its objectives is to provide a simple yet efficient material clamping device for attachment on a conventional sewing or embroidering machine.

It is still another objective of the present invention to provide a clamping device and method of use whereby a relatively unskilled worker can prepare a selected material for quality embroidering.

It is a further objective of the present invention to provide a clamping device for affixing to a sewing machine and which can be adjusted vertically and horizontally with relative ease.

It is still another objective of the present invention to provide a clamping device for a sewing machine which can be used on a large variety of materials of different sizes, thicknesses and configuration without the need of adjustment to the clamping device.

It is yet another objective of the present invention to provide a clamping device for a sewing machine having a pair of arms which are vertically movable to engage and maintain the selected material in a fixed relation.

It is a further objective of the present invention to provide a clamping device having a pair of arms, each with a flexible blade to securely engage the material to prevent movement in one horizontal direction, yet which tightens the material in the opposite horizontal direction.

Various other objectives and advantages of the present invention will become apparent to those skilled in the art as a more detailed description is set forth below.

SUMMARY OF THE INVENTION

The aforesaid and other objectives are realized by providing a material clamping device and method of use which assures speed and efficiency during the installation and stitching or embroidering process. The clamping device includes a pair of arms extend from the sewing machine towards the operator proximate the sewing head. Each of the arms include a fixed and a vertically movable section whereby a finger lever affixed to a cam raises and lowers the movable arm section to release or clamp selected material therebetween. Each of the arms also include a bracket for affixing the arm to a mounting plate attached to the sewing machine at the sewing head. Allen head screws in the bracket allow the arm to adjust vertically and a threaded member with a knob allows each of the arms to be spatially aligned, one to the other as they move horizontally along the mounting plate. In use the levers are raised thereby opening the movable section of the arms for engagement with a material such as a shirt fabric or the like. Once the arms engage the material the levers are closed to provide a tightening effect to the fabric. The sewing head is then utilized to embroider or stitch on the tightened material. Once the pattern or design is embroidered completely the levers can be lifted, the material removed from the clamping device and another type or thickness of material can be inserted and tightened for sewing without horizontal movement of the arms.

The invention as described allows for manual manipulation but could be made to operate with pneumatic air cylinders or with an electric motor. Foot controls could also be included.

DETAILED DESCRIPTION OF THE PREFERRED EMBODIMENT AND OPERATION OF THE INVENTION

Figure 1:
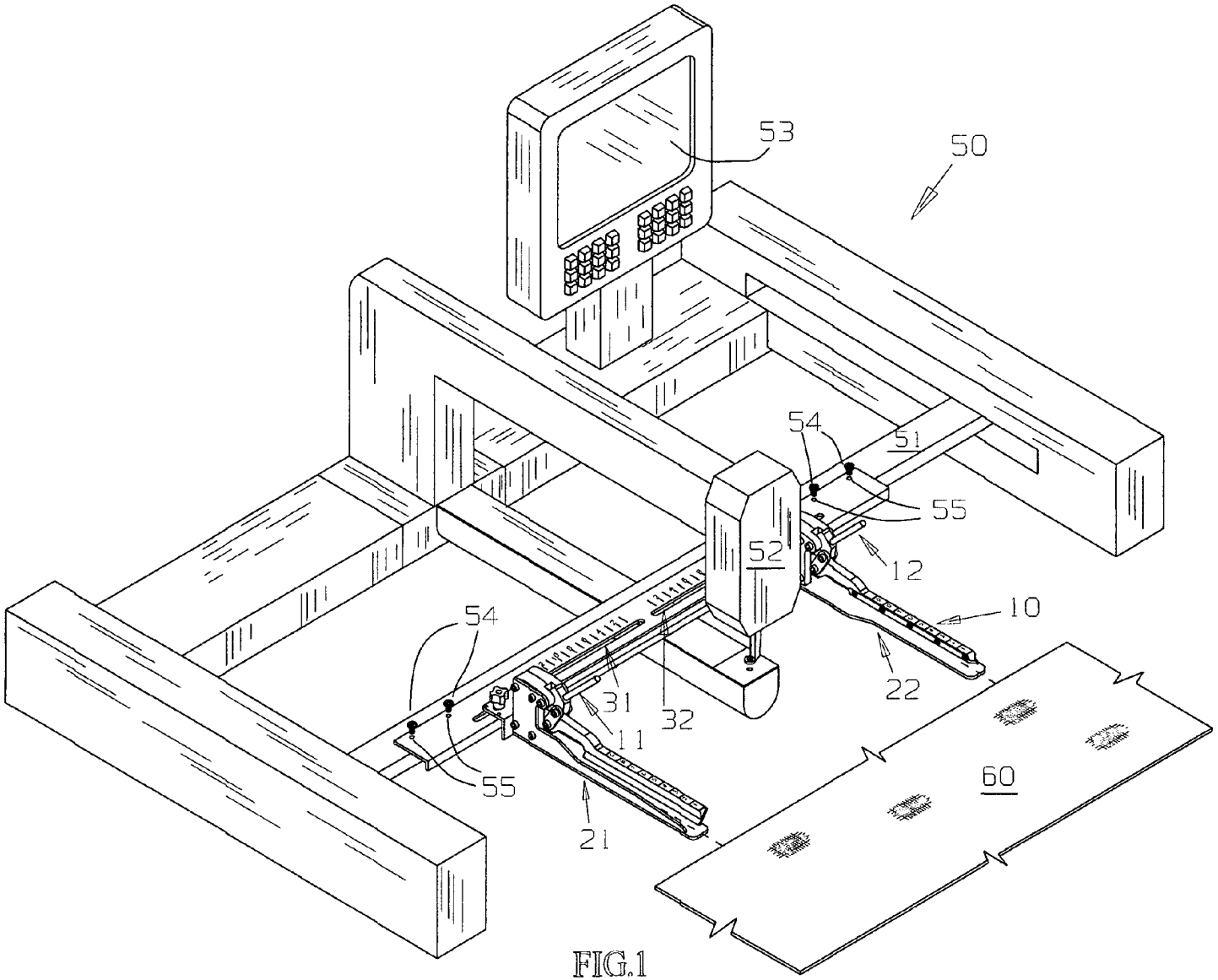
FIG. 1 shows in schematic representation a typical single head embroidering machine with the clamping device of the invention thereon.

For a better understanding of the invention and its operation, turning now to the drawings. FIG. 1 illustrates preferred clamping device 10 formed from steel or other suitable material attached to frame member 51 of sewing machine 50. Sewing machine 50 is a typical head embroidery machine having sewing head 52 with a single needle (not shown) for embroidering, stitching or sewing materials such as caps, jackets, shirts or the like. Conventional control panel 53 allows the operator to program and/or direct X-Y movements of frame member 51 and sewing head 52 as required during the stitching or embroidering process.

Clamping device 10 is affixed to X-Y frame member 51 by bolts 52. Bolts 54 pass through apertures 55 in L-shaped mounting plate 30 seen enlarged in FIG. 2. Mounting plate 30 includes slots 31, 32 which allows arms 21, 22 to slide therealong for adjusting the space between arms 21 and 22 as required, depending on the size of the selected item and the pattern to be stitched or embroidered thereon. Scale 39 seen in FIG. 2 is positioned on mounting plate 30 for accuracy and convenience in aligning the selected item during adjusting.

Figure 2:
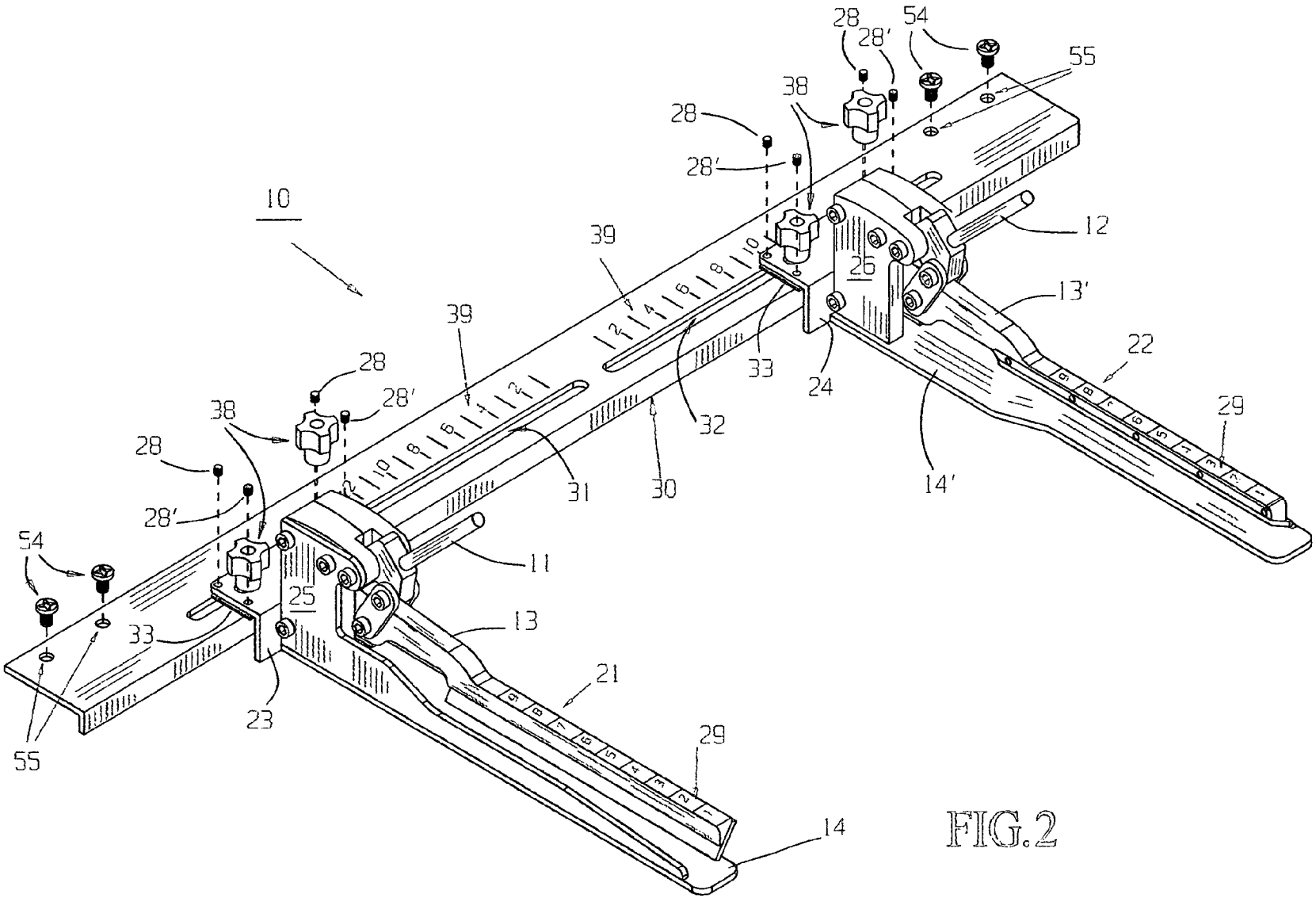
FIG. 2 illustrates an enlarged view of the clamping device as seen in FIG. 1 removed from the sewing machine.
Figure 3:
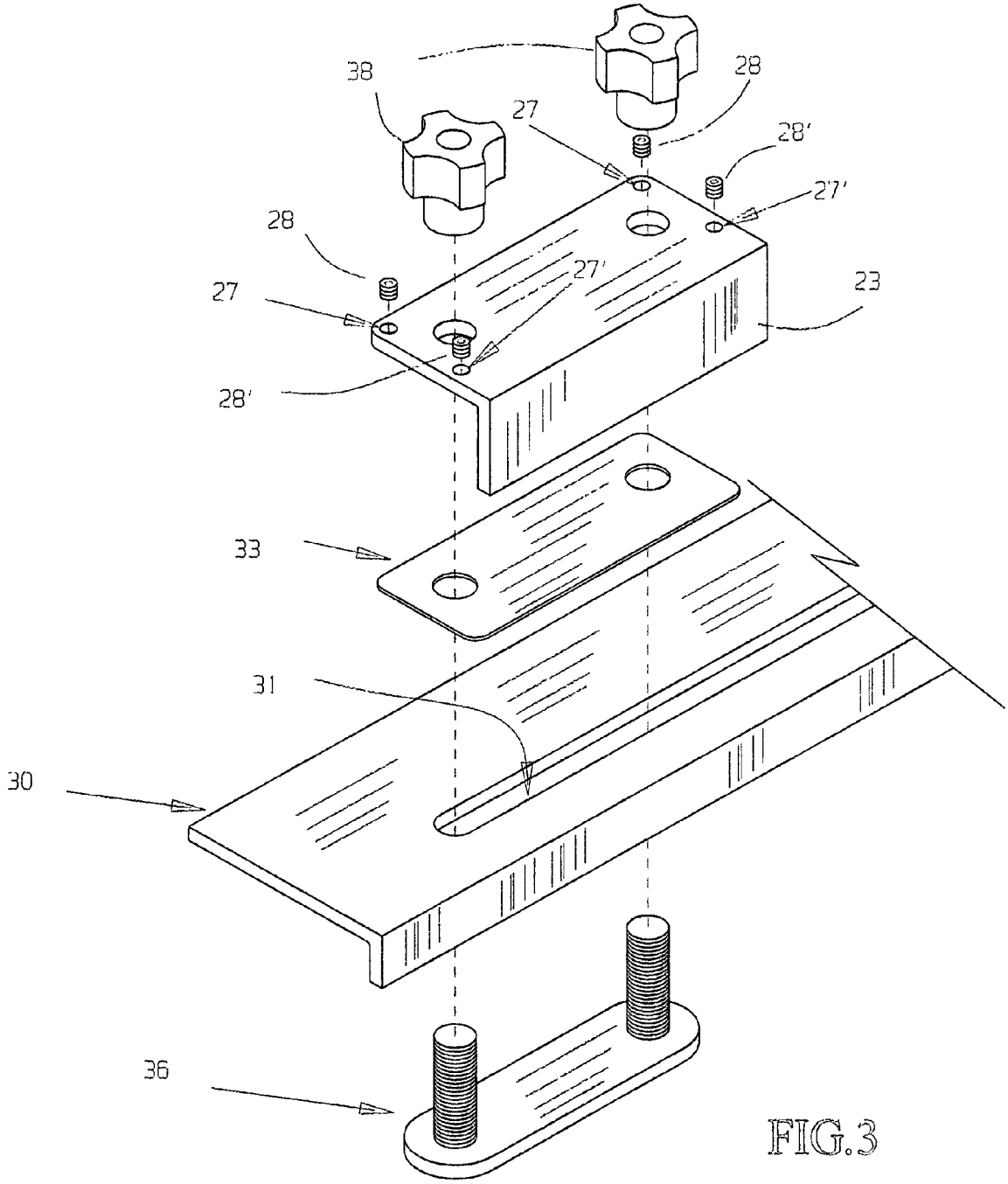
FIG. 3 demonstrates an exploded schematic view of the attachment of one arm of the clamping device with certain components as removed from the sewing machine.
Figure 4:
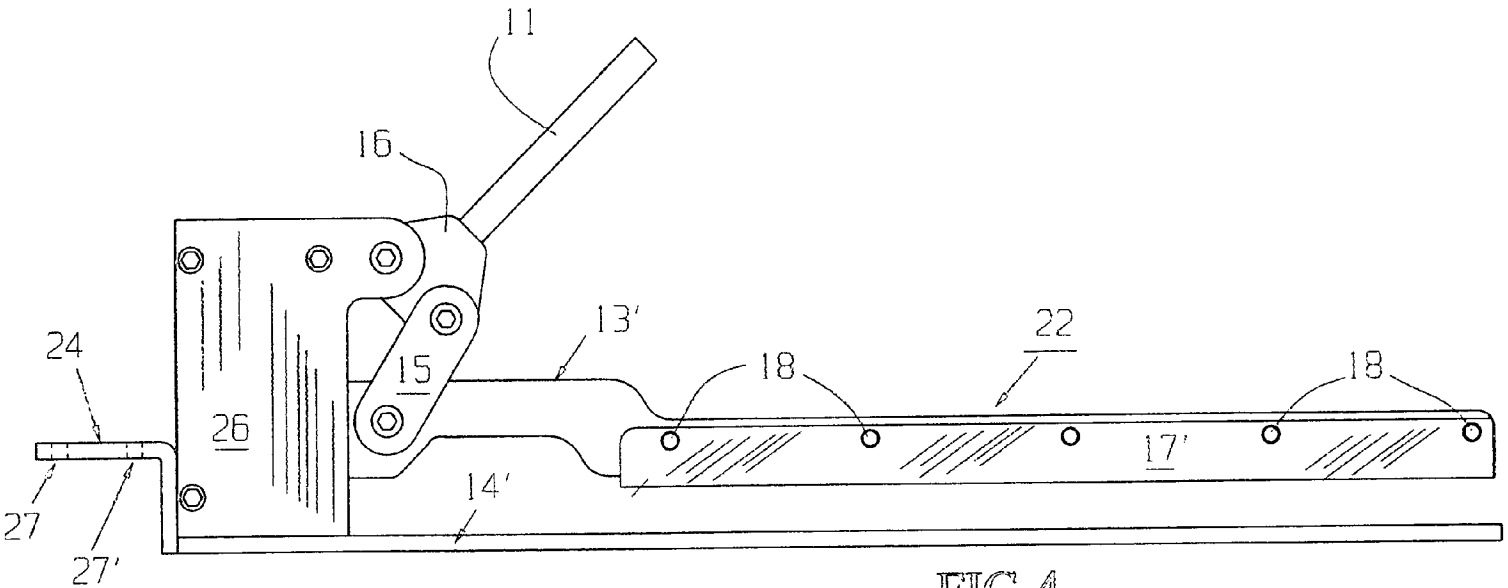
FIG. 4 pictures a side elevational view of one arm of the clamping device as seen in FIG. 2 in an open posture with the fabric removed.
Figure 5:
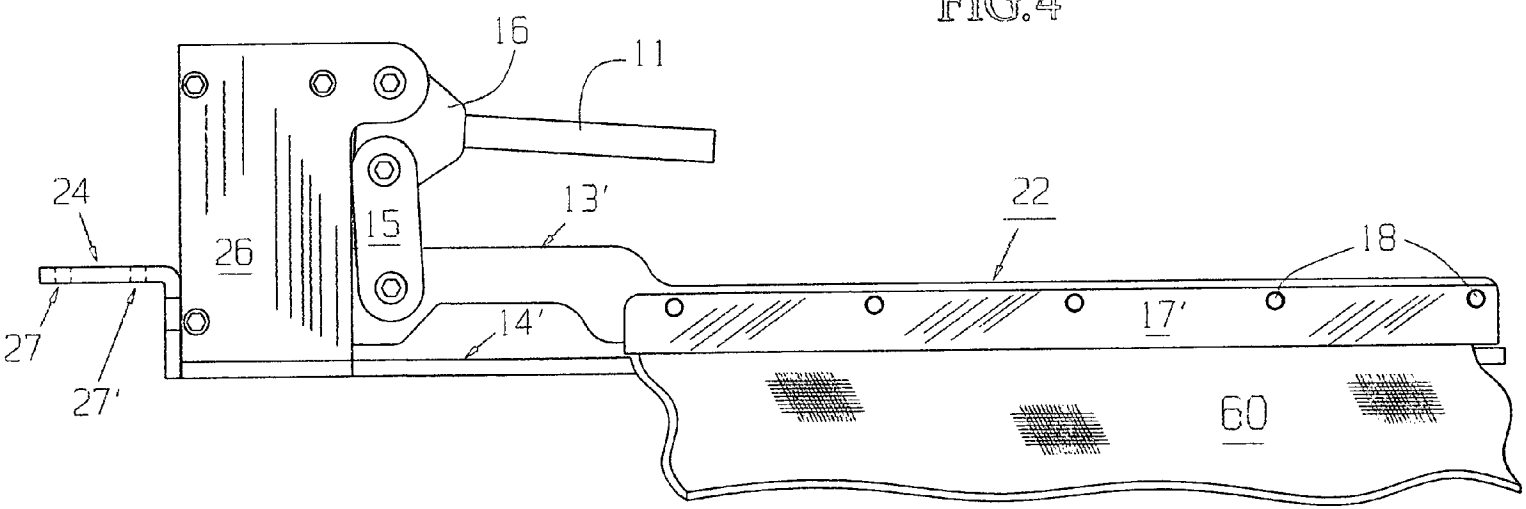
FIG. 5 shows the arm of the clamping device as shown in FIG. 4 in a closed posture with the selected material clamped therein.

Arms 21, 22 include L-shaped brackets 23, 24 respectively as seen in FIGS. 2, 4 and 5 for adjustably affixing arms 21, 22 to mounting plate 30. L-shaped brackets 23, 24 are attached to arm frame members 25, 26 such as by welding or the like. In FIG. 3 an enlarged, exploded view of brackets 23 is shown removed from frame member 25 of arm 21. As seen, threaded member 36 passes through slot 31 of mounting plate 30, planar spacer 33 and bracket 23 where it engages knob 38 for tightening purposes. Threaded apertures 27, 27' in brackets 23, 24 contain respectively allen head screws 28, 28' (FIG. 2) which can be adjusted against for example planar spacer 33 to raise or lower the vertical alignment of arms 21, 22 on mounting plate 30 as needed.

When arms 21, 22 are suitably spaced along mounting plate 30 using scale 39 for receiving fabric 60 or other material as shown in FIG. 1, lever 11 is lifted as shown for arm 22 in FIG. 4, pulling cam 16 upwardly to raise movable arm section 13' from fixed arm section 14'. As further shown in FIG. 4, linkage 15 is pivotally affixed to cam 16 and to movable arm 13'. Upon closure of lever 11 as seen in FIG. 5, linkage 15 is urged into first, a vertical posture and as lever 11 is then fully closed, the upper end of linkage 15 moves (pivots) further (from right to left in FIG. 5) for locking purposes. Thus lever 11 will not easily move from its position as shown in FIG. 5 and will not allow flexible blade 17' to lift unintentionally as the upper end of linkage 15 rotates past the imaginary center line (not seen) to "lock" arm section 13' in place.

Figure 7:
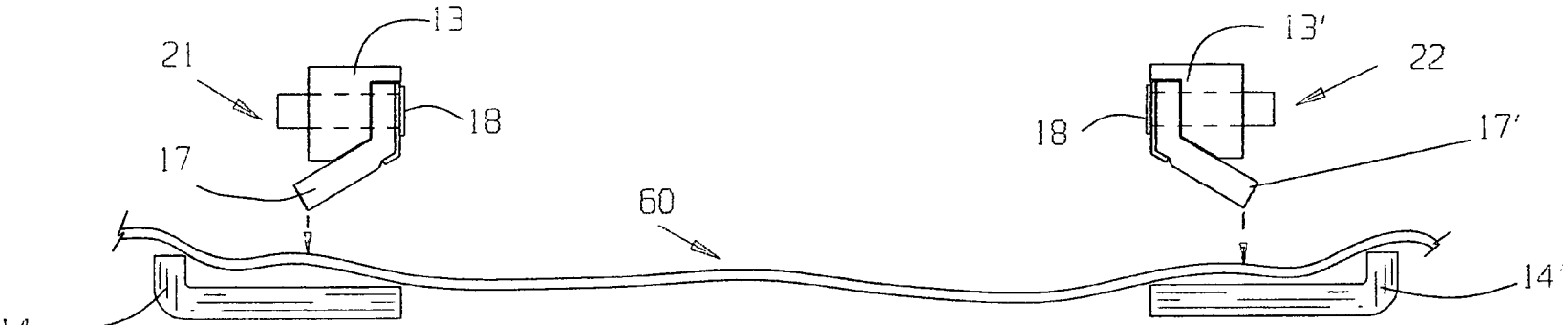
FIG. 7 shows in schematic representation the arms of the clamping device with fabric in place in a loose format prior to clamping.
Figure 8:
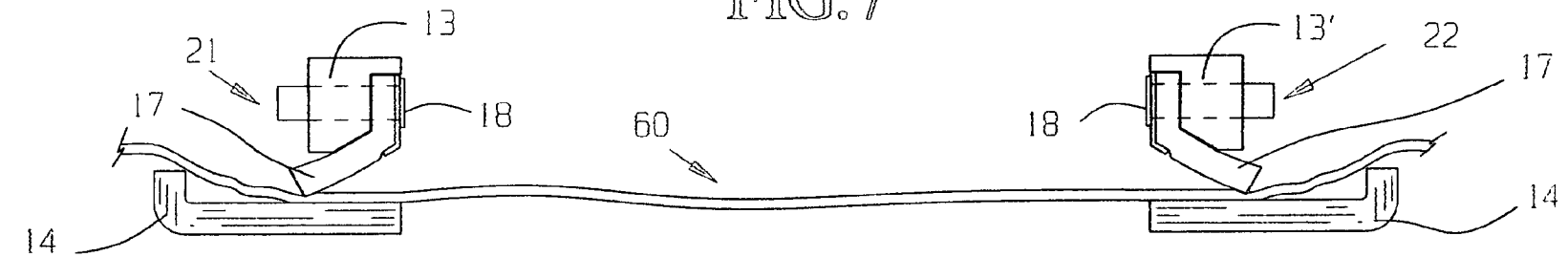
FIG. 8 depicts schematically the arms of FIG. 7 in an initial closed posture on the material.
Figure 9:
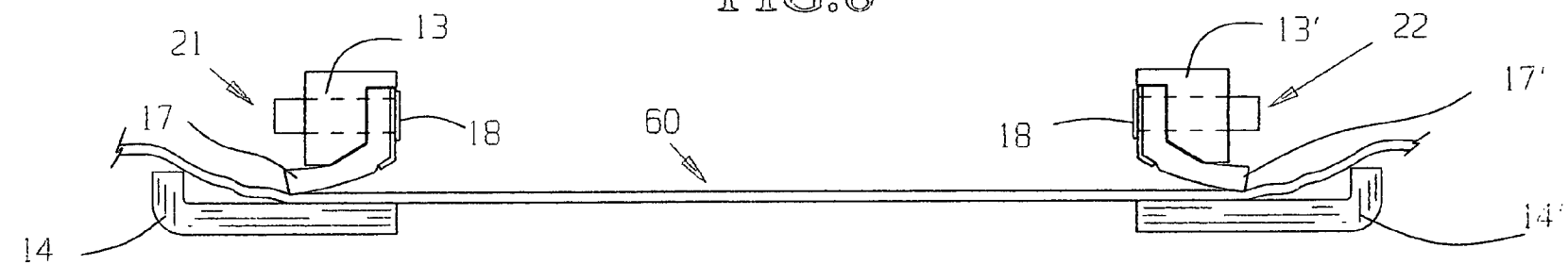
FIG. 9 demonstrates the fabric as seen in FIG. 8 tightly engaged in the arms of the clamping device.

Movable arm sections 13, 13' include flexible blades 17, 17' which are preferably formed from a resilient neoprene rubber or the like to apply pressure at an outward angle of preferably 30° to fabric 60 as shown in FIG. 9 or other materials held in place by movable arm sections 13, 13' when closed on fixed arm sections 14, 14' (see also FIGS. 7-8). While blades 17, 17' are preferably 30°, other suitable angles may be utilized. Scales 29 (FIG. 2) on movable arm sections 13, 13' allow for positioning of the material at a suitable depth within arms 21, 22. Blades 17, 17' are affixed to vertically movable arm sections 13, 13' such as by rivets 18 or the like as shown in FIGS. 4, 5 and 7-9.

Figure 6:
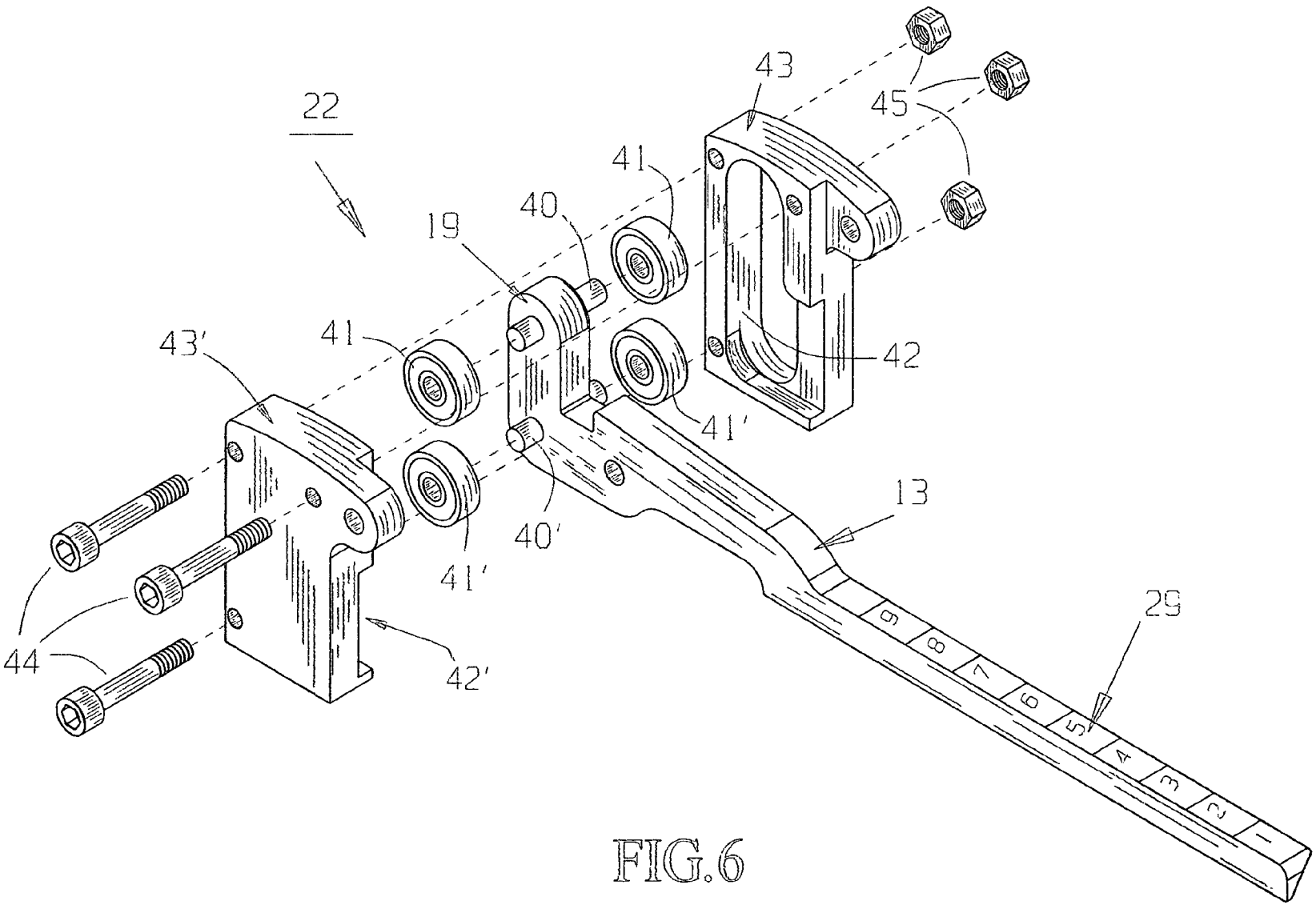
FIG. 6 demonstrates an exploded, enlarged partial view of certain components of one of the arms.

FIG. 6 illustrates an exploded partial view of arm 22 with movable arm section 13 inclining vertical post 19. Post 19 contains axles 40, 40' which engage opposing pairs of roller ball bearings 41, 41' respectively. Roller ball bearings 41, 41' are contained within races 42, 42' (Δ' not shown) of arm housing half sections 43, 43' respectively and assist in the vertical motion of arms 21, 22 when raising or lowering levers 11, 12. As would be understood, arm housing half section 43, 43' are connected by bolts 44 which receive nuts 45 also shown in FIG. 6 during assembly. In FIG. 7, material 60 which is to be embroidered is shown placed on fixed arm sections 14, 14' respectively of arms 21, 22. Blades 17, 17' in FIGS. 8 and 9 flex or bend as movable arm sections 13, 13' respectively engage material 60 until arms 21, 22 are in their lowermost position with blades 17, 17' fully engaging and clamping material 60 to thereby prevent slippage as material 60 becomes taut as in FIG. 9. With material 60 taut, sewing head 52 can now be adjusted as usual for sewing material 60. When blades 17, 17' contact material 60 as seen in FIGS. 7-8 and blades 17, 17' bend, this forces material 60 outwardly from the center and makes material 60 taut as seen in FIG. 9.

Once the sewing or embroidering is completed, sewing head 52 is withdrawn, levers 11, 12 (FIG. 2) are raised and material 60 is removed and replaced with the next item to be embroidered.

The preferred method includes the steps of attaching mounting plate 30 with arms 21, 22 as shown in FIGS. 1 and 2 on machine frame member 51. Knobs 38 are loosened and arms 21, 22 are then spaced apart a selected distance using scales 39 as seen in FIG. 2 and are then tightened on threaded members 36 (FIG. 3). Arms 21, 22 are then opened by raising levers 11, 12 as shown in FIG. 2 and an item to be sewn such as material 60 seen in FIGS. 1 and 5 is then selected. Material 60 is then placed between movable arm sections 13, 13' at a chosen depth using scales 29 and fixed arm sections 14, 14' respectively of arms 21, 22. Levers 11, 12 are then lowered to clamp material 60 in place. Flexible blades 17, 17' lock down on material 60. If material 60 is loose between arms 21, 22 then a slight manual tug on material 60 from the outside of arms 21, 22 will pull material 60 from the inside to the outside of arms 21, 22. Thus, clamping device 10 will hold material 60 and resist material 60 from sliding under angled blades 17, 17' from the outside to the inside of clamping device 10. As necessary, allen head screws 28, 28' as shown in FIG. 2 can be tightened or loosened for vertical alignment of arms 21, 22 prior to material 60 insertion.

Next, sewing head 52 as shown in FIG. 1 can be lowered or moved, such as by moving frame member 51 as required and the final adjustments are made so that sewing by head 52 can then commence. Thereafter, levers 11, 12 are lifted and material 60 removed and another item or material is placed in arms 21, 22 and the cycle is repeated.

The illustrated and example provided herein are for explanatory purposes and are not intended to limit the scope of the appended claims.

I claim:

1. A sewing machine clamping device comprising: a first arm, a second arm, said first arm comprising a fixed section and a movable section, said movable section movable to clamp material between said fixed and said movable sections, a blade, said blade affixed to said movable section to angularly contract the material and force it outwardly to tighten the material between said first arm and said section arm.

2. The clamping device of claim 1 wherein said second arm comprises a movable section and a fixed section.

3. The clamping device of claim 1 said blade is resilient.

4. The clamping device of claim 3 wherein said blade is flexible.

5. The clamping device of claim 1 wherein said movable section comprises a cam, a lever, said lever attached to said cam, said cam engaging said movable section for directing said movable section.

6. The clamping device of claim 1 further comprising a mounting plate, said mounting plate defining a slot, a bracket, said bracket attached to said first arm to adjustably affix said first arm to said mounting plate.

7. The clamping device of claim 6 wherein said bracket defines an aperture, a threaded member, said threaded member positioned in said aperture and in said slot for securing said first arm at a desired location on said mounting plate.

8. The clamping device of claim 7 further comprising a knob, said knob threadably affixed on said threaded member.

9. A clamping device for a sewing machine comprising: a first arm, a second arm, said first and said second arms spatially attached to a sewing machine, each of said first and said second arms comprising a fixed section and a movable section, said movable sections movable to clamp material between said fixed and said movable sections, a pair of handles, a pair of cams, each of said pair of handles attached to different ones of said pair of cams, each of said pair of cams engaging different ones of said movable sections for directing said movable sections.

10. The clamping device of claim 9 wherein each of said movable sections comprises a blade, said blade formed from a flexible material.

11. A method of clamping materials for sewing utilizing a sewing machine and a clamping device having a pair of arms, each of said arms having a movable section and a fixed section, the movable sections each including a resilient blade angularly disposed to the fixed section, the method comprising the steps of:

a) spacing the arms a selection distance;

b) placing material between the arms;

c) adjusting the movable sections to clamp the material between the blades and the fixed sections; and d) allowing the blades to tighten the material between the arms.

12. The method of claim 11 further comprising the step of sewing the clamped material.

13. The method of claim 11 wherein placing the material between the arms comprises the step of manually placing the material in each of the arms.

14. The method of claim 11 wherein spacing the arms comprises the step of moving one of said arms relative to the other arm along the sewing machine.

15. The method of claim 11 wherein moving the arms comprises the step of moving one section of one arm manually.

* * * * *